US010573248B2

(12) United States Patent
Mao et al.

(10) Patent No.: US 10,573,248 B2
(45) Date of Patent: Feb. 25, 2020

(54) BACKLIGHT DRIVING DEVICE AND DISPLAY DEVICE COMPRISING THE SAME

(71) Applicant: Innolux Corporation, Miao-Li County (TW)

(72) Inventors: Li-Wei Mao, Miao-Li County (TW); Tai-Chieh Huang, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 202 days.

(21) Appl. No.: 15/646,097

(22) Filed: Jul. 11, 2017

(65) Prior Publication Data

US 2018/0018924 A1 Jan. 18, 2018

(30) Foreign Application Priority Data

Jul. 18, 2016 (CN) ..... 2016 1 0563099

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/3648* (2013.01); *G09G 2310/08* (2013.01); *G09G 2320/064* (2013.01)

(58) Field of Classification Search
CPC ..... G09G 2310/08; G09G 2320/064; G09G 3/3406; G09G 3/3426; G09G 3/3648
See application file for complete search history.

(56) References Cited

U.S. PATENT DOCUMENTS

2006/0284577 A1* 12/2006 Shin ..... H05B 41/2851 315/360
2008/0238336 A1* 10/2008 Peng ..... G09G 3/3426 315/294
2010/0020004 A1* 1/2010 Smith ..... G09G 3/342 345/102
2010/0220047 A1* 9/2010 Adachi ..... G02F 1/133603 345/102

(Continued)

FOREIGN PATENT DOCUMENTS

CN 101471043 7/2009
CN 104298041 1/2015
CN 105374329 3/2016

OTHER PUBLICATIONS

"Office Action of China Counterpart Application", dated Apr. 29, 2019, p. 1-p. 6.

*Primary Examiner* — Viet D Pham
(74) *Attorney, Agent, or Firm* — JCIPRNET

(57) ABSTRACT

A backlight driving device including a light source array, a driving circuit and a scanning circuit is provided. The light source array includes backlight units electrically connected to scanning lines and driving lines. The driving circuit outputs driving signals to the backlight units through the driving lines, and the driving signals respectively includes driving pulses in different time intervals. The scanning circuit outputs scanning signals to the backlight units through the scanning lines, and the scanning signals respectively includes a start pulse in at least one of the time intervals. The start pulses of the scanning signals respectively correspond to the driving pulses in the same time interval, and drive the backlight units of the each row of the light source array in time-division.

16 Claims, 6 Drawing Sheets

(56) References Cited

U.S. PATENT DOCUMENTS

| | | | | |
|---|---|---|---|---|
| 2011/0050110 | A1* | 3/2011 | Han | H05B 33/0818<br>315/185 R |
| 2013/0120481 | A1* | 5/2013 | Murai | G09G 3/3406<br>345/690 |

* cited by examiner

BACKLIGHT DRIVING DEVICE AND DISPLAY DEVICE COMPRISING THE SAME

CROSS-REFERENCE TO RELATED APPLICATION

This application claims the priority benefit of China application serial no. 201610563099.5, filed on Jul. 18, 2016. The entirety of the above-mentioned patent application is hereby incorporated by reference herein and made a part of this specification.

BACKGROUND OF THE DISCLOSURE

Field of the Disclosure

The disclosure relates to a driving device, and particularly relates to a backlight driving device and a display device comprising the same.

Description of Related Art

In the technique field of display driving, liquid crystal displays (LCD) are gradually developed toward a trend of large size, and there are more and more researches on how to improve a resolution and image quality of the LCD. However, in recent years, backlight modules for the LCDs are gradually developed to have an adjusting technique of local dimming, so as to adjust a brightness of each light-emitting region. However, the conventional local dimming technique is to pull out a driving line from each of the light-emitting regions, and couple a plurality of drivers through a plurality of connectors to respectively adjust the brightness of the light-emitting regions. Namely, since the conventional local dimming technique requires a large number of connectors and drivers, the conventional backlight driving device having the local dimming function generally requires a large mechanical space. Therefore, it is an important issue to design a backlight driving device having a local dimming function with high efficiency, and having a low mechanical space requirement.

SUMMARY OF THE DISCLOSURE

An embodiment of the disclosure provides a backlight driving device including a light source array, a driving circuit and a scanning circuit. The light source array includes a plurality of backlight units arranged in an array, and the backlight units are electrically connected through a plurality of scanning lines and a plurality of driving lines. The driving circuit outputs a plurality of driving signals to the backlight units through the driving lines, and the driving signals respectively include a plurality of driving pulses in different time intervals. The scanning circuit outputs a plurality of scanning signals to the backlight units through the scanning lines, and the scanning signals respectively include a start pulse in at least one of the time intervals. The start pulses of the scanning signals respectively correspond to the driving pulses in the same time interval, and drive the backlight units of the each row of the light source array in time-division.

An embodiment of the disclosure provides a display device including a display panel and a backlight driving device. The backlight driving device is disposed corresponding to the display panel. The backlight driving device includes a light source array, a driving circuit and a scanning circuit. The light source array includes a plurality of backlight units arranged in an array, and the backlight units are electrically connected through a plurality of scanning lines and a plurality of driving lines. The driving circuit outputs a plurality of driving signals to the backlight units through the driving lines, and the driving signals respectively include a plurality of driving pulses in different time intervals. The scanning circuit outputs a plurality of scanning signals to the backlight units through the scanning lines, and the scanning signals respectively include a start pulse in at least one of the time intervals. The start pulses of the scanning signals respectively correspond to the driving pulses in the same time interval, and drive the backlight units of the each row of the light source array in time-division.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
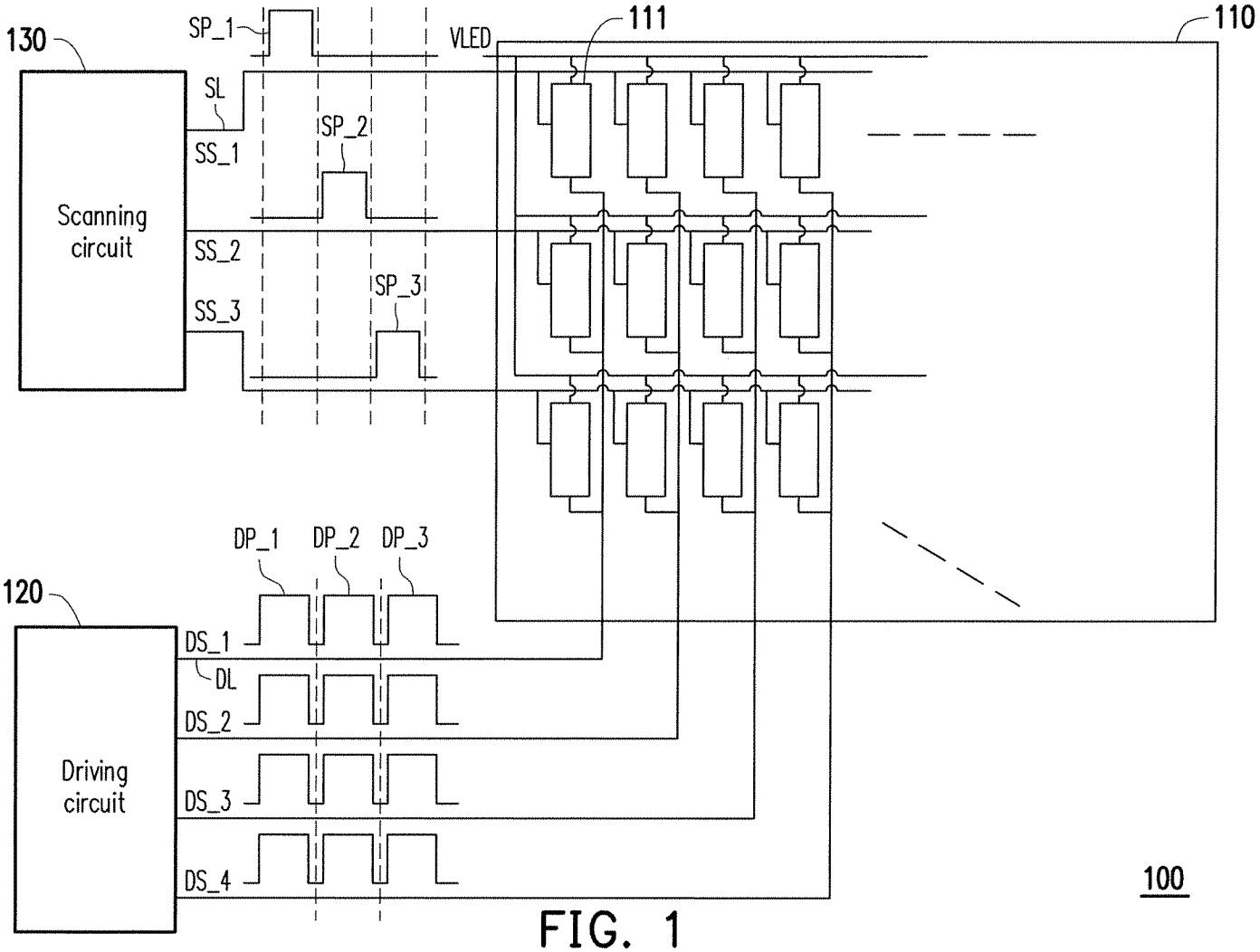
FIG. 1 is a block schematic diagram of a backlight driving device according to an embodiment of the disclosure.

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

FIG. 1 is a block schematic diagram of a backlight driving device according to an embodiment of the disclosure. Referring to FIG. 1, the backlight driving device 100 includes a light source array 110, a driving circuit 120 and a scanning circuit 130. The light source array 110 includes a plurality of backlight units 111 arranged in an array having M columns and N rows, where M and N are positive integers greater than 0.

In the present embodiment, each of the backlight units 111 corresponds to a light-emitting region of the light source array 110. The driving circuit 120 is coupled to the light source array 110, and is used for outputting a plurality of same driving signals DS_1, DS_2, DS_3, DS_4 to each of the backlight units 111 in the light source array 110. The scanning circuit 130 is coupled to the light source array 110, and is used for outputting a plurality of scanning signals SS_1, SS_2, SS_3 to each of the backlight units 111 in the light source array 110.

In the present embodiment, each of the driving signals DS_1, DS_2, DS_3 and DS_4 is composed of driving pulses DP_1, DP_2 and DP_3, and the scanning signals SS_1, SS_2, SS_3 respectively include start pulses SP_1, SP_2 and SP_3, where the start pulses SP_1, SP_2 and SP_3 of the scanning signals SS_1, SS_2, SS_3 are sequentially output for respectively corresponding to the driving pulses DP_1, DP_2 and DP_3 of the same time intervals in the driving signals DS_1, DS_2, DS_3 and DS_4. Namely, each of the backlight unit 111 may receive the same driving pulses DP_1, DP_2 and DP_3. However, since the received scanning signals SS_1, SS_2 and SS_3 are different, a time that each row of the backlight units 111 sequentially receives the start pulses SP_1, SP_2 and SP_3 is different.

In the present embodiment, the backlight units of each column of the light source array 110 may respectively share a same driving line DL, such that the driving circuit 120 may respectively output the driving signals DS_1, DS_2, DS_3 and DS_4 to the backlight units 111 of each column in the light source array 110 through the driving line DL shared by each column of the backlight units 111. In the present embodiment, the backlight units of each row of the light source array 110 may respectively share a same scan line SL, such that the scanning circuit 130 may respectively output the scanning signals SS_1, SS_2 and SS_3 to the backlight units 111 of each row of the light source array 110 through the scan line SL shared by each row of the backlight units 111. To be specific, in the present embodiment, the scanning circuit 130 outputs the scanning signals SS_1, SS_2 and SS_3 to the backlight units 111 of each row of the light source array 110, and sequentially provides the start pulses SP_1, SP_2 and SP_3 to the backlight units 111 of each row of the light source array 110. In this way, the backlight units 111 of the same row may receive the scanning signal of the same scanning line SL, and the backlight units 111 of different rows sequentially receive the start pulses SP_1, SP_2 and SP_3. Therefore, in the present embodiment, when one of the backlight units 111 receives a start pulse, the light source array 110 may drive the backlight unit according to the driving pulse corresponding to the same time interval in the driving signal.

It should be noted that, in the present embodiment, the backlight units of each column of the light source array 110 are designed to share the same driving line DL, and the backlight units of each row are designed to share the same scanning line SL. Therefore, the number of overall pins of the light source array 110 can be determined according to the number of the shared driving lines DL and the number of the shared scanning lines SL, and it is unnecessary to pull out a driving line and a scanning line from each of the backlight units 111 of the light source array 110. Even more, the backlight driving device 100 may drive all of the backlight units 111 through one piece of the driving circuit 120. Namely, the backlight driving device 100 of the present embodiment may have a circuit design for sharing the driving lines DL and sharing the scanning lines SL, so as to save the number of pins of the light source array 110, and further save the number of connectors required for coupling the light source array 110 to the driving circuit 120 and the scanning circuit 130. Meanwhile, by using the scanning circuit 130, the backlight driving device 100 of the present embodiment may have an effect of saving the number of the driving circuits or a channel number the driving circuit.

For example, it is assumed that the light source array 110 has 4 columns and 3 rows of the backlight units 111, and when the backlight units of the second row of the light source array 110 receive the start pulse SP_2 in the scanning signal SS_2, each of the backlight units 111 of the second row of the light source array 110 is driven by each of the driving pulses DP_2 in the driving signals DS_1, DS_2, DS_3 and DS_4 corresponding to the same time interval. In this way, the light source array 110 may drive the backlight units of each row of the light source array 110 in time-division, and use the driving pulses in the driving signals to drive the backlight units 111 of different columns in partitions. Moreover, in the above example, the number of pins of the light source array 110 is 7 (4 shared driving lines and 3 shared scanning lines), so that the driving circuit 120 only requires 4 channels for coupling to the light source array 110, and the scanning circuit 130 only requires 3 channels for coupling to the light source array 110. Even more, the backlight driving device 100 only requires one connector having 4 pins and one connector having 3 pins for respectively coupling the driving circuit 120 and the scanning circuit 130 to the light source array 110. Namely, the circuit structure design of the backlight driving device 100 of the present embodiment may obviously decrease the number of the driving circuits, the scanning circuits or the connectors, so as to further save the mechanical space of the backlight driving device 100. Moreover, in the present embodiment, the time-division driving and partition driving refer to that all of or a part of the backlight units 111 in the light source array 110 can be driven in the same time interval or different time intervals according to a display effect required by the user or a device specification of the display device, which is not limited by the disclosure.

However, in the present embodiment, the number of the backlight units 111 (i.e. the number of the light-emitting regions) in the light source array 110 is not limited to the number shown in FIG. 1, and FIG. 1 is only a schematic diagram for explaining the embodiment of the disclosure. In the present embodiment, the number of the backlight units 111 can be determined according to the user's requirement or the specification of the display device, which is not limited by the disclosure. Moreover, in the present embodiment, duty cycles of the pulses of the driving signals and the scanning signals used in the backlight units 111, and the distributed time intervals of the scanning signals can be determined according to the display effect required by the user and the device specification of the display device, which are not limited by the disclosure.

Moreover, in the present embodiment, the backlight driving device 100 can be applied to display devices of any size and any type, for example, liquid crystal displays (LCD), thin-film transistor LCD (TFT-LCD) or Quantum Dot(QD) display, etc., which is not limited by the disclosure. Moreover, in the present embodiment, the driving circuit 120 may, for example, include a constant current regulator and a pulse width modulation (PWM) circuit, where the PWM circuit may modulate a constant current signal to output a plurality of consecutive and periodically varied pulses to serve as the driving signals of the disclosure. Moreover, in the present embodiment, the scanning circuit 130 is, for example, a central processing unit (CPU), a microcontroller (MCU), a timing controller, an oscillator, etc., or a combination thereof used for outputting the scanning signals of the disclosure, which is not limited by the disclosure.

Figure 2:
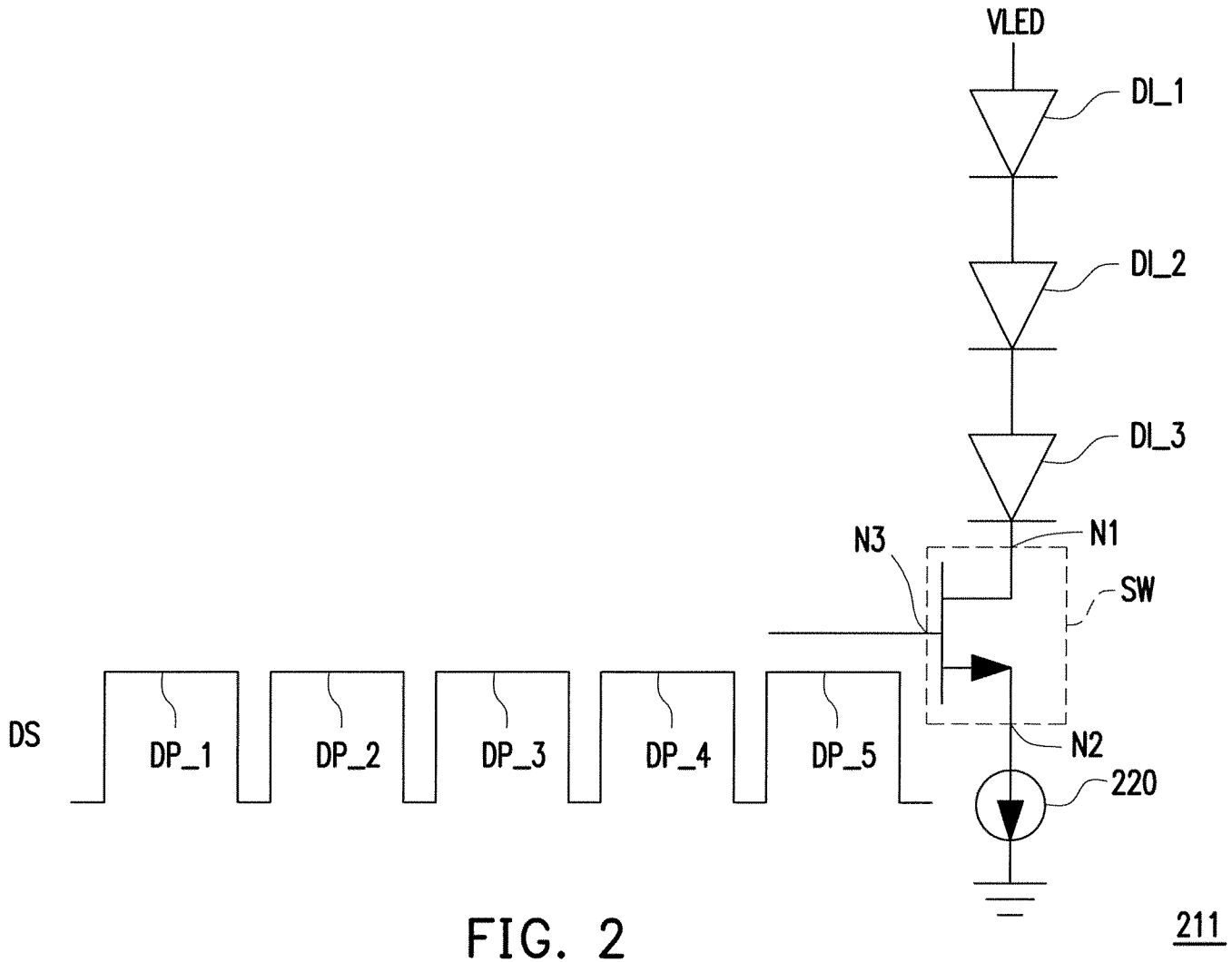
FIG. 2 is a circuit schematic diagram of a backlight unit of a same column according to an embodiment of the disclosure.

FIG. 2 is a circuit schematic diagram of a backlight unit of a same column according to an embodiment of the disclosure. Referring to FIG. 2, the backlight unit 211 may represent a column of backlight units in the light source array 110, and the backlight unit 211 may include a plurality of light-emitting diodes (LEDs) DI_1, DI_2, DI_3 and a first switch element SW. In the present embodiment, the LEDs DI_1, DI_2, DI_3 connected in series are coupled to a driving voltage VLED at a positive voltage terminal, and the LEDs DI_1, DI_2, DI_3 connected in series are coupled to a first terminal N1 of the first switch element SW at a negative voltage terminal. A second terminal N2 of the first switch element SW can be coupled to an equivalent constant current source 220. In the present embodiment, a control terminal of the first switch element SW is used for receiving the driving signal DS, where the driving signal DS has a plurality of driving pulses DP_1, DP_2, DP_3, DP_4 and DP_5, and the driving pulses all have the same duty cycle.

Moreover, referring to FIG. 1 and FIG. 2, for example, it is assumed that the backlight unit 211 represents a backlight unit in a light source array with 20 columns and 10 rows, so that the scanning circuit 130 has to output scanning signals to 10 scanning lines, where the scanning signal of each scanning line respectively has a start pulse, and a total time of one cycle of the scanning signal is allocated to the backlight units of 10 rows, so that a time length of each start pulse occupied in one cycle of the scanning signal is 1/10. Namely, regarding the backlight units of different rows, a duty cycle of each start pulse in the scanning signal SS of one cycle is smaller than or equal to 10%. Therefore, in the present embodiment, the number of the scanning signals and the duty cycle of the start pulse occupied in one cycle of the scanning signal are determined according to the number of rows of the light source array.

Moreover, in the present embodiment, a voltage magnitude of the driving voltage VLED are determined according to the number of the LEDs connected in series. For example, when a driving voltage required by each of the LEDs is 3V, and the driving circuit requires 0.5V, the driving voltage VLED is then 9.5V (3*3V+0.5V). However, the number of the serially connected LEDs configured in the backlight units is not limited to the number shown in FIG. 2. In an embodiment, the number of the LEDs in the light-emitting regions can be determined according to the user's requirement or the device specification of the display device, which is not limited by the disclosure.

Figure 3:
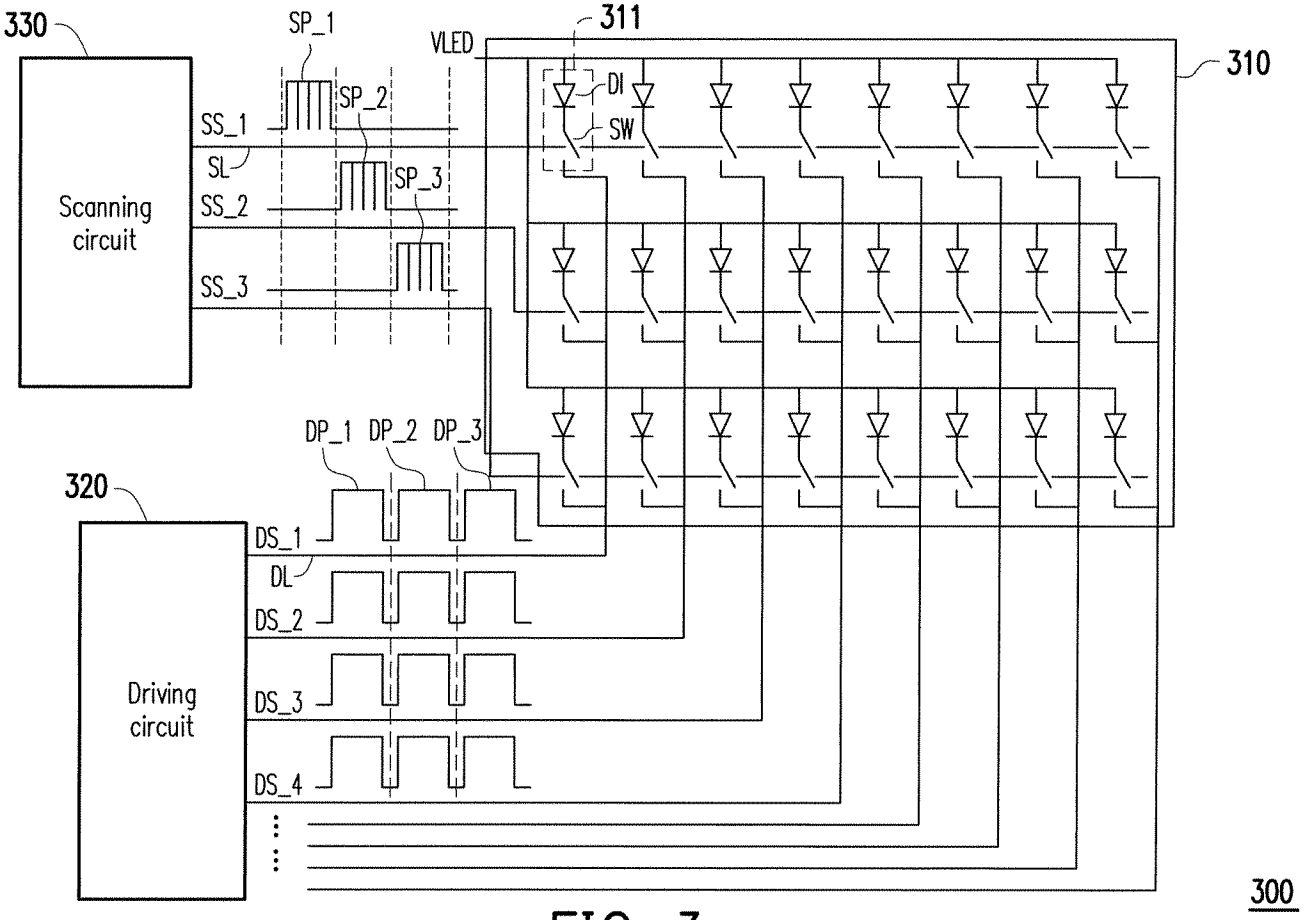
FIG. 3 is a circuit schematic diagram of a backlight driving device according to an embodiment of the disclosure.

FIG. 3 is a circuit schematic diagram of a backlight driving device according to an embodiment of the disclosure. Referring to FIG. 3, the backlight driving device 300 includes a light source array 310, a driving circuit 320 and a scanning circuit 330. The light source array 310 includes a plurality of backlight units 311 arranged in an array, where each of the backlight units 311 corresponds to one light-e ing region of the light source array 310. In the present embodiment, the light source array 310 has a plurality of the backlight units 311 arranged in an array, where the light source array 310 includes 8 columns and 3 rows. Namely, the light source array 310 can be divided into 24 light-emitting regions (8 columns and 3 rows).

In the present embodiment, each of the backlight units 311 may include a first switch element SW and at least one LED DI. The backlight units of each column of the light source array 310 may respectively share a same driving line DL, such that the driving circuit 320 may respectively output eight driving signals DS_1, DS_2, DS_8 to the backlight units of each column of the light source array 110 through the driving line DL shared by the backlight units of each column. In the present embodiment, the eight driving signals DS_1, DS_2, DS_8 may have same waveform. In the present embodiment, the backlight units of each row of the light source array 310 may respectively share a same scanning line SL, such that the scanning circuit 330 may respectively output scanning signals SS_1, SS_2, SS_3 to the backlight units of each row of the light source array 110 through the scanning line SL shared by the backlight units of each row. In this way, the light source array 310 may drive the backlight units of each row in the light source array 310 in time-division.

In the present embodiment, the scanning signals SS_1, SS_2, SS_3 provided by the scanning circuit 330 may respectively have different start pulses SP_1, SP_2, SP_3, and the start pulses SP_1, SP_2, SP_3 may further respectively have different sub-start pulses adapted to be sequentially provided to the backlight units of each row, such that the backlight units of the same row may receive the different sub-start pulses.

Figure 4:
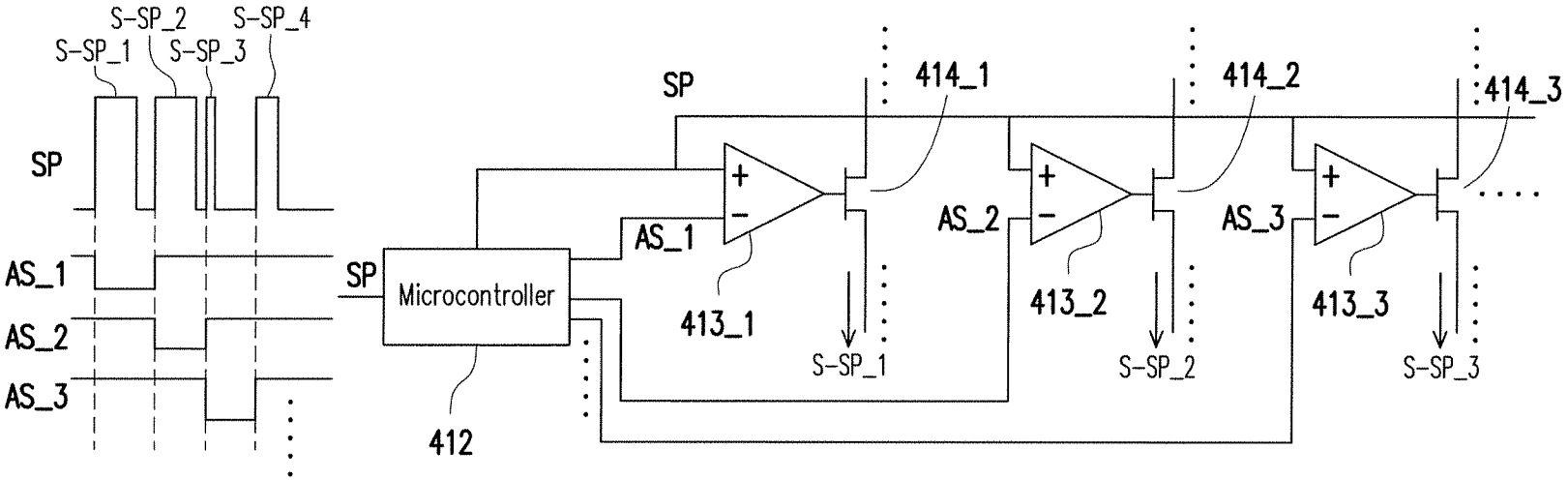
FIG. 4 is a circuit structure diagram of a backlight unit of a same row in an embodiment of the disclosure.

To be specific, FIG. 4 is a circuit structure diagram of a backlight unit of a same row in an embodiment of the disclosure. Referring to FIG. 4, when the backlight units of one row of the light source array receive the start pulse SP, the sub-start pulses S-SP_1, S-SP_2, S-SP_3, S-SP_4 of the start pulse SP can be sequentially provided to the backlight units of the same row through a microcontroller 412 and a plurality of second switch elements 414_1, 414_2 and 414_3. In the present embodiment, when the microcontroller 412 receives the start pulse SP of the scanning signal output by the scanning circuit, the microcontroller 412 outputs the start pulse SP to non-inverted input terminals of comparators 413_1, 413_2, 413_3 and first terminals of the second switch elements 414_1, 414_2, 414_3. Moreover, the microcontroller 412 may further generate addressing signals AS_1, AS_2, AS_3 for providing to inverted input terminals of the comparators 413_1, 413_2, 413_3. In the present embodiment, the addressing signals AS_1, AS_2, AS_3 are pulse signals arranged in sequence, such that the comparators 413_1, 413_2, 413_3 may sequentially turn on the second switch elements 414_1, 414_2, 414_3. In this way, the second switch elements 414_1, 414_2, 414_3 may output the sub-start pulses S-SP_1, S-SP_2, S-SP_3 for providing to the first switch element of the corresponding backlight unit, so as to drive the backlight units of the same row in time-division.

Namely, referring to FIG. 3 and FIG. 4, the backlight driving device of the present embodiment may implement partition dimming control for the backlight units of the same row. In the present embodiment, the sub-start pulses S-SP_1, S-SP_2, S-SP_3 can be respectively designed to have duty cycles of 60%, 70%, 20% in a time length of one sub-start pulse. Therefore, when the backlight units of the same row receive the sub-start pulses S-SP_1, S-SP_2, S-SP_3 in time-division, whether the first switch elements SW of each of the backlight units of the same row is turned on is respectively determined according to the sub-start pulses S-SP_1, S-SP_2, S-SP_3, and a driving time of at least one LED DI of each backlight unit of the same row is respectively determined by the duty cycles of the sub-start pulses S-SP_1, S-SP_2, S-SP_3. In this way, the backlight driving device 300 of the embodiment of FIG. 3 may implement partition dimming control for each of the backlight units 311.

It should be noted that, in the overall scanning signals, the number of the sub-start pulses is smaller than or equal to the number of columns of the light source array. Therefore, the number of the columns of the light source array may influence a time length occupied by the sub-start pulse in the start pulse of one cycle or a duty cycle of the sub-start pulse. For example, in the present embodiment, the light source array 310 of FIG. 3 is a backlight unit array of 8 columns and 3 rows. Therefore, a cycle length of each of the start pulses SP_1, SP_2, SP_3 in the scanning signals SS_1, SS_2, SS_3 is further divided into 8 equal parts, such that one start pulse may include 8 sub-start pulses, and a time length occupied by each of the sub-start pulses in the start pulse of one cycle is ⅛. However, in the present embodiment, the duty cycles of the sub-start pulses S-SP_1, S-SP_2, S-SP_3 in the time length of the respective start pulse are determined by the number of the columns of the light source array designed according to the user's requirement or the device specification of the display device, which is not limited by the disclosure.

Moreover, in the present embodiment, the number of the backlight units in the light source array 310 and the number of the LEDs in the backlight units are not limited to the numbers shown in FIG. 3, and in an embodiment, the light source array may have backlight units of 20 columns and 9 rows (i.e. 20*9 light-emitting regions), or backlight units of 10 columns and 9 rows or 20 columns and 18 rows, etc., and the number of LEDs in each of the backlight units is, for example, 5 or 9, which is not limited by the disclosure. Moreover, since enough instructions and recommendations for the driving signals, the scanning signals and the technical features of related circuits of the embodiment of FIG. 3 and FIG. 4 can be learned from the descriptions of the embodiment of FIG. 1 and FIG. 2, detailed description thereof is not repeated.

Figure 5:
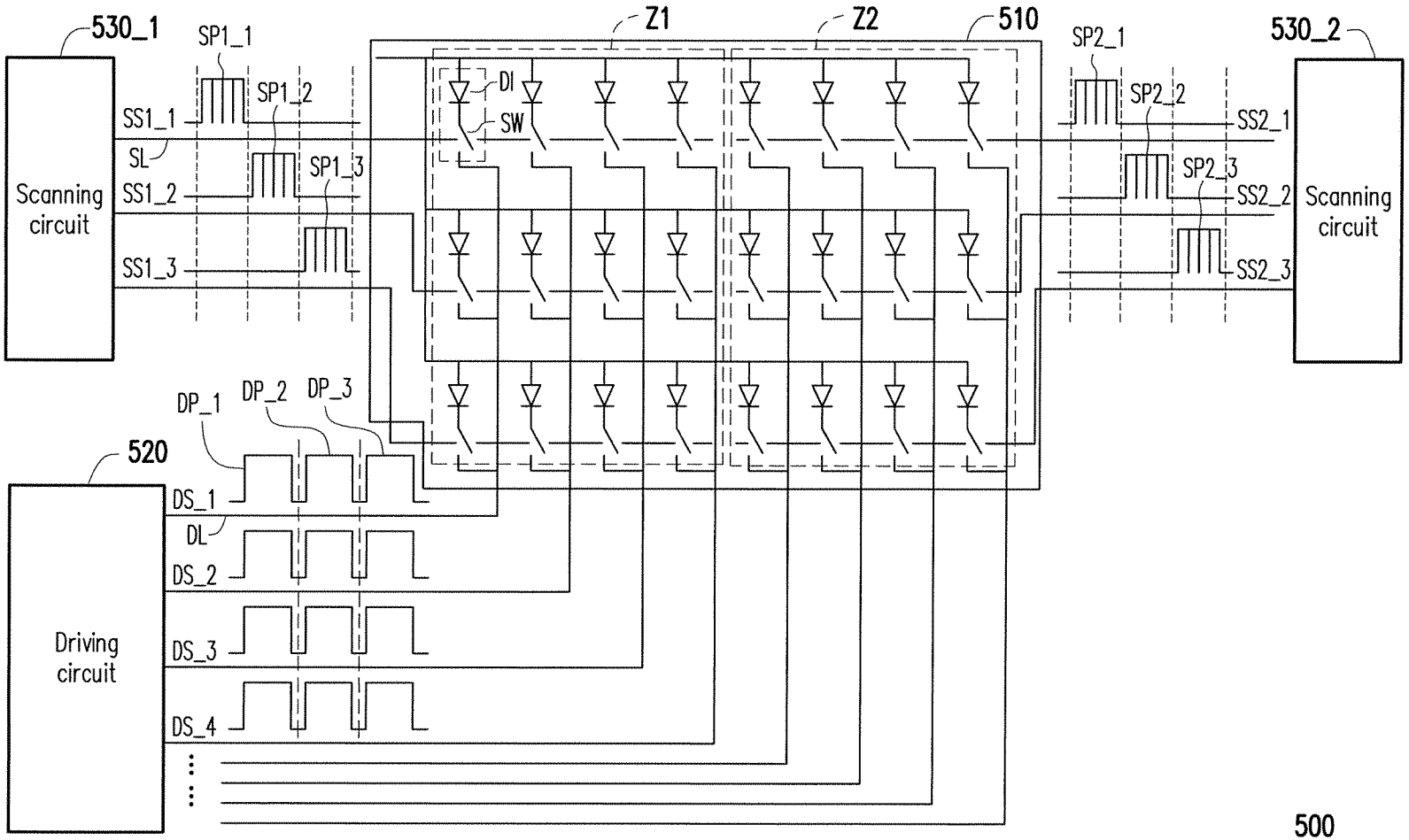
FIG. 5 is a circuit structure of a backlight driving device according to another embodiment of the disclosure.

FIG. 5 is a circuit structure of a backlight driving device according to another embodiment of the disclosure. Referring to FIG. 5, the backlight driving device 500 includes a light source array 510, a driving circuit 520 and scanning circuits 530_1, 530_2. Compared to the embodiment of FIG. 3, in the present embodiment, the light source array 510 can be divided into two scanning zones Z1, Z2 to respectively implement local dimming, so that the driving circuit 520 can be coupled to two scanning circuits 530_1, 530_2. In the present embodiment, the scanning circuit 530_1 provides scanning signals SS1_1, 551_2 and SS1_3 to the backlight units of each row of the scanning zone Z1, and the scanning circuit 530_2 provides scanning signals SS2_1, SS2_2 and SS2_3 to the backlight units of each row of the scanning zone Z2. Moreover, the scanning circuits 530_1, 530_2 may respectively output these scanning signals in the same time interval or in different time intervals, which is not limited by the disclosure.

In the present embodiment, the backlight driving device 500 may also use the two scanning circuits 530_1, 530_2 to respectively implement local dimming. By increasing the scanning circuit, the number of the sub-start pulses in the start pulses respectively provided by the scanning circuits 530_1, 530_2 is only four. Namely, each row has 8 backlight units, and the scanning circuits 530_1, 530_2 are only required to provide four sub-start pulses to the backlight units of the same row. Therefore, in one start pulse, since the number of the required sub-start pulses is decreased by twice, a time length of the sub-start pulse is increased by twice, i.e. a time length of the sub-start pulse in one start pulse is increased. In other words, compared to the embodiment of applying only one scanning circuit, since the number of the sub-start pulses required to be provided by two scanning circuits in a fixed time length is decreased, the two scanning circuits may respectively provide more accurate sub-start pulses.

In the present embodiment, the backlight driving device 500 adopts two scanning circuits 530_1 and 530_2 to respectively implement local dimming. Namely, in the present embodiment, the number of pins of the light source array 510 is 14 (8 shared driving lines+3 scanning lines of the scanning zone Z1+3 scanning lines of the scanning zone Z2), so that the driving circuit 520 requires 8 channels for coupling to the light source array 510, and the scanning circuits 530_1, 530_2 respectively require 3 channels for coupling to the light source array 510. Moreover, the backlight driving device 500 only requires one connector with 8 pins and two connectors with 3 pins for respectively coupling the driving circuit 520 and the scanning circuits 530_1, 530_2 to the light source array 510.

Namely, compared to the conventional technique of pulling out a driving line from each of the backlight units for individually coupling to the driving circuit, the backlight driving device 500 of the present embodiment may obviously decrease the required driving circuits, and a performance requirement of the scanning circuit and the number of the connectors, and may support more number of the backlight units or the light-emitting regions, so as to achieve the effect of saving the mechanical space of the backlight driving device 500 and provide good resolution.

Moreover, in the present embodiment, the number of the backlight units in the light source array 510 is not limited to the number shown in FIG. 5, and in an embodiment, the number of the light-emitting regions of the light source array 510 can be determined according to the user's requirement or the device specification of the display device, which is not limited by the disclosure. Moreover, since enough instructions and recommendations for the driving signals, the scanning signals and the technical features of related circuits of the embodiment of FIG. 5 can be learned from the descriptions of the embodiments of FIG. 1-FIG. 4, detailed description thereof is not repeated.

Figure 6:
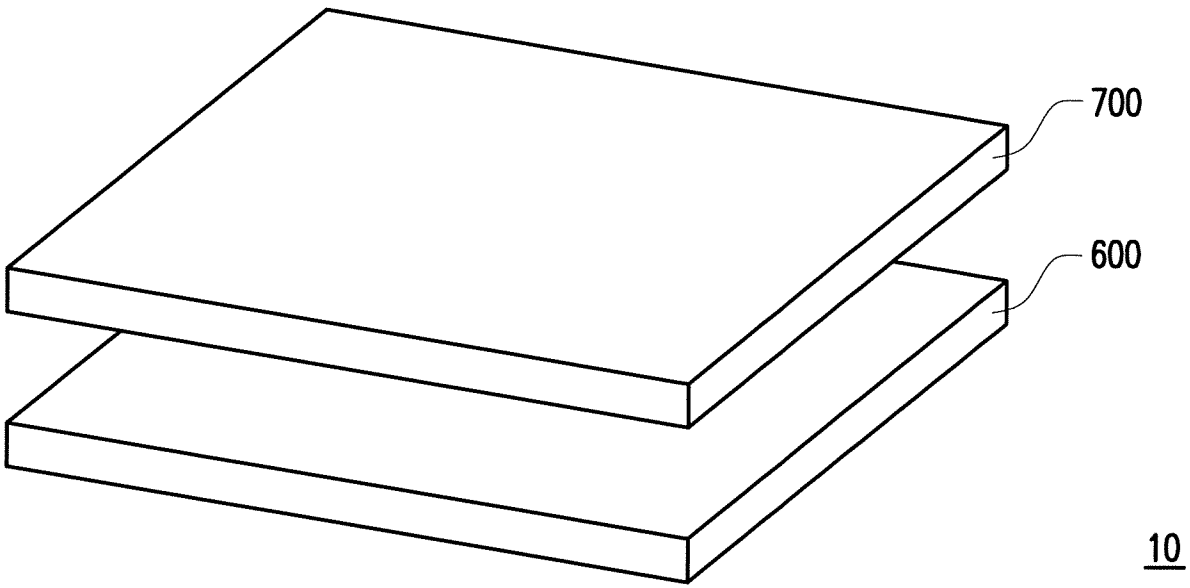
FIG. 6 is a schematic diagram of a display according to an embodiment of the disclosure.

FIG. 6 is a schematic diagram of a display device according to an embodiment of the disclosure. Referring to FIG. 6, the display device 10 includes a backlight driving device 600 and a display panel 700, and the backlight driving device 600 is disposed corresponding to the display panel 700. In the present embodiment, the display panel 700 can be a LCD panel, a TFT-LCD panel or Quantum Dot(QD) display etc., which is not limited by the disclosure. Moreover, the backlight driving device 600 can be the backlight driving device of the embodiment of FIG. 1, FIG. 3 and FIG. 5. Therefore, in the present embodiment, since enough instructions and recommendations for the technical features of the backlight driving device of the embodiment of FIG. 6 can be learned from the descriptions of the embodiments of FIG. 1, FIG. 3 and FIG. 5, detailed description thereof is not repeated.

In summary, in the embodiments of the disclosure, the backlight driving device drives the backlight units in the light source array by using the driving circuit and the scanning circuit, and though the design of the driving signals and scanning signals, the backlight driving device of the disclosure may drive the backlight units of different rows of the light source array in time-division. In the embodiments of the disclosure, duty cycles of the pulses of the driving signals and the scanning signals applied to the backlight units, and distributed time intervals of the sub-start pulses in the scanning signals can be determined according to a display effect required by the user or a device specification of the display device. Moreover, the number of the connectors and the number of the driving circuits of the backlight driving device of the disclosure can be further decreased through the circuit design that the backlight units share the driving lines and the scanning lines. Moreover, the backlight driving device of the embodiments of the disclosure may implement scanning by dividing the light source array into two scanning zones, though in other embodiments of the disclosure, more scanning zones can be divided according to an actual requirement. In other embodiments of the disclosure, distribution locations of the driving signals and the scanning signals can also be exchanged, which is not limited by the disclosure.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A backlight driving device, comprising:

a light source array, having a plurality of backlight units arranged in an array, wherein the backlight units are electrically connected through a plurality of scanning lines and a plurality of driving lines;

a driving circuit, outputting a plurality of driving signals to the backlight units through the driving lines, wherein the driving signals respectively comprise a plurality of driving pulses with a same amplitude in different time intervals; and a first scanning circuit, sequentially outputting a plurality of first scanning signals to the backlight units through the scanning lines, wherein the first scanning signals respectively comprise a first start pulse in at least one of the different time intervals, wherein the first start pulses of the first scanning signals respectively correspond to the driving pulses in the same time interval, and drive the backlight units of the each row in time-division, wherein each column of the light source array further comprises a light-emitting diode and a first switch element, and the light-emitting diode is coupled to the first switch element, wherein a positive electrode of the light-emitting diode is coupled to a driving voltage, a negative electrode of the light-emitting diode is coupled to a first terminal of the first switch element, a control terminal of the first switch element receives the driving pulses, and a second terminal of the first switch element is coupled to an equivalent constant current source.

2. The backlight driving device as claimed in claim 1, wherein the driving pulses have a same duty cycle.

3. The backlight driving device as claimed in claim 1, wherein one of the driving lines is electrically connected to the backlight units of at least one column.

4. The backlight driving device as claimed in claim 3, wherein one of the scanning lines is electrically connected to the backlight units of at least one row, or the backlight units of the same row are electrically connected to at least one of the scan lines.

5. The backlight driving device as claimed in claim 1, wherein the first start pulse respectively have a plurality of sub-start pulses, and the number of the sub-start pulses is smaller than or equal to the number of columns of the light source array.

6. The backlight driving device as claimed in claim 5, wherein duty cycles of the sub-start pulses are different.

7. The backlight driving device as claimed in claim 5, wherein each row of the light source array further comprises:

a plurality of comparators, coupled to control terminals of a plurality of second switch elements; and a microcontroller, coupled to the comparators, and configured to receive one of the first scanning signals, wherein the microcontroller outputs the sub-start pulses to first terminals of the second switch elements and non-inverted input terminals of the comparators, and outputs a plurality of addressing signals to inverted input terminals of the comparators, and the comparators respectively determine whether to output the sub-start pulse corresponding to the same time interval to the backlight units of each row through second terminals of the second switch elements according to the sub-start pulses and the addressing signals.

8. The backlight driving device as claimed in claim 1, further comprising:

a second scanning circuit, outputting a plurality of second scanning signals to the backlight units through the scanning lines, wherein the second scanning signals respectively comprise a second start pulse in the at least one of the time intervals, wherein the second start pulses of the second scanning signals respectively correspond to the driving pulses in the same time interval.

9. A display device, comprising:

a display panel; and a backlight driving device, disposed corresponding to the display panel, wherein the backlight driving device comprises:

a light source array, having a plurality of backlight units arranged in an array, wherein the backlight units are electrically connected through a plurality of scanning lines and a plurality of driving lines;

a driving circuit, outputting a plurality of driving signals to the backlight units through the driving lines, wherein the driving signals respectively comprise a plurality of driving pulses with a same amplitude in different time intervals; and a first scanning circuit, sequentially outputting a plurality of first scanning signals to the backlight units through the scanning lines, and the first scanning signals respectively comprise a first start pulse in at least one of the different time intervals, wherein the first start pulses of the first scanning signals respectively correspond to the driving pulses in the same time interval, and drive the backlight units of the each row in time-division, wherein each column of the light source array further comprises a light-emitting diode and a first switch element, and the light-emitting diode is coupled to the first switch element, wherein a positive electrode of the light-emitting diode is coupled to a driving voltage, a negative electrode of the light-emitting diode is coupled to a first terminal of the first switch element, a control terminal of the first switch element receives the driving pulses, and a second terminal of the first switch element is coupled to an equivalent constant current source.

10. The display device as claimed in claim 9 wherein the driving pulses have a same duty cycle.

11. The display device as claimed in claim 9, wherein one of the driving lines is electrically connected to the backlight units of at least one column.

12. The display device as claimed in claim 11, wherein one of the scanning lines is electrically connected to the backlight units of at least one row, or the backlight units of the same row are electrically connected to at least one of the scan lines.

13. The display device as claimed in claim 9, wherein the first start pulse respectively have a plurality of sub-start pulses, and the number of the sub-start pulses is smaller than or equal to the number of columns of the light source array.

14. The display device as claimed in claim 13, wherein duty cycles of the sub-start pulses are different.

15. The display device as claimed in claim 13, wherein each row of the light source array further comprises:

a plurality of comparators, coupled to control terminals of a plurality of second switch elements; and a microcontroller, coupled to the comparators, and configured to receive one of the first scanning signals, wherein the microcontroller outputs the sub-start pulses to first terminals of the second switch elements and non-inverted input terminals of the comparators, and outputs a plurality of addressing signals to inverted input terminals of the comparators, and the comparators respectively determine whether to output the sub-start pulse corresponding to the same time interval to the backlight units of each row through second terminals of the second switch elements according to the sub-start pulses and the addressing signals.

16. The display device as claimed in claim 9, further comprising:

a second scanning circuit, outputting a plurality of second scanning signals to the backlight units through the scanning lines, wherein the second scanning signals respectively comprise a second start pulse in the at least one of the time intervals, wherein the second start pulses of the second scanning signals respectively correspond to the driving pulses in the same time interval.

* * * * *